United States Patent [19]

Jackson et al.

[11] 4,098,049

[45] Jul. 4, 1978

[54] APPARATUS AND METHODS FOR IMPREGNATING OIL INTO A LUBRICATING PAD

[75] Inventors: William G. Jackson, Virginia Beach; Lance Seibert, Chesapeake; Dillard T. Bates, Norfolk; James M. Smith, Virginia Beach, all of Va.

[73] Assignee: Norfolk & Western Railway Company, Roanoke, Va.

[21] Appl. No.: 755,493

[22] Filed: Dec. 29, 1976

[51] Int. Cl.[2] ..... B65B 3/10; B65B 57/06; B65B 39/12

[52] U.S. Cl. ..... 53/22 B; 53/36; 53/37; 53/59 R; 53/112 B; 53/266 R; 206/205; 206/318

[58] Field of Search ..... 53/22 B, 24, 36, 37, 53/21 FC, 112 B, 124 A, 187, 266, 59 R; 206/205, 209, 318, 361

[56] References Cited

U.S. PATENT DOCUMENTS

| | | | |
|---|---|---|---|
| 2,496,609 | 2/1950 | Antwerpen | 53/124 A |
| 2,925,719 | 2/1960 | Robbins et al. | 53/36 X |
| 3,359,703 | 12/1967 | Quaadgras | 53/59 R |
| 3,471,990 | 10/1969 | Bonuchi et al. | 53/22 B |
| 3,618,283 | 11/1971 | Moore et al. | 53/21 FC |
| 3,812,649 | 5/1974 | Clancy | 53/187 |

FOREIGN PATENT DOCUMENTS

| | | | |
|---|---|---|---|
| 963,144 | 7/1964 | United Kingdom | 53/22 B |

*Primary Examiner*—Robert Louis Spruill
*Attorney, Agent, or Firm*—Finnegan, Henderson, Farabow & Garrett

[57] ABSTRACT

Disclosed are apparatus and methods for impregnating oil into a lubricating pad for use in a journal box. A conveyor locates a bag containing a dry pad below an oil dispensing spout. If desirable or for particularly large bags and pads, a vacuum suction may be applied to opposite sides of the open upper end of the bag to hold it open. The spout is lowered and oil is dispensed into the bag. After the spout is raised, the bag containing the pad and oil is conveyed between a pair of platens which compress the bag and pad therebetween substantially fully exhausting air from the bag. While maintaining the bag and pad compressed, the open end of the bag is hermetically sealed. Upon movement of the platens away from one another, the pad expands within the bag with consequent impregnation of oil into the pad.

9 Claims, 7 Drawing Figures

PRESSURIZED OIL
PRESSURIZED AIR
TO VACUUM SOURCE
SO1
SO2
T1
LS1
LS2
LS3
M1
10
12
14
16
18
20
22
24
28
30
32
36
36a
38
42
44
48
50
52
62
63
112
114
124
130
174
178

APPARATUS AND METHODS FOR IMPREGNATING OIL INTO A LUBRICATING PAD

The present invention relates to apparatus and methods for impregnating oil into a lubricator pad and particularly relates to apparatus and methods for impregnating lubricating oil into lubricating pads used in journal boxes of railway cars.

The sleeve-type bearing on each end of a freight car axle requires a resilient lubricator pad to wick oil from the bottom of the journal box to the journal bearing. The lubricator pad is disposed in the bottom of the journal box and is in contact with the axle journal.

Prior to instaling a new lubricator pad in a journal box, the pad must be impregnated with oil to assure proper wicking action. Conventionally, this impregnation is accomplished by soaking the lubricator pad in hot oil unitil a sufficient quantity of oil is absorbed by the pad. This is a time consuming, inconvenient, and a generally manual operation.

The present invention provides apparatus and methods for impregnating lubricating oil into a lubricating pad which minimizes or eliminates many of the foregoing noted and other problems associated with prior lubricating pads for use in railway journal boxes and provides a novel and improved apparatus and methods for impregnating lubricating oil into the lubricating pads used in railway car journal boxes having various advantages in manufacture and use in comparison with such prior apparatus and methods. Particularly, the present invention provides apparatus and methods for substantially automating the process of impregnating lubricating oil into lubricator pads. More particularly, this is accomplished preferably by providing a conveyor having an oil dispensing station and a compression and sealing station. Dry lubricator pads are disposed in open topped plastic bags and conveyed to a location below an oil dispensing nozzle at the oil dispensing station. An oil dispensing nozzle is automatically lowered into the open bag to dispense a predetermined quantity of oil into the bag and about the pad. After the bag is filled with the required quantity of oil, the nozzle is automatically retracted and the bag is conveyed to the compression and sealing station.

At the compression and sealing station, the bag and pad are compressed between a pair of platens substantially exhausting air from the bag. The platens carry heat-sealing elements along their upper edges which serve to hermetically seal the bag with the oil and pad therein and while the bag and pad are maintained under compression by the platens. Once sealed, the compression is relieved enabling the pad to naturally expand to substantially its previous volume thereby absorbing substantially all oil within the bag into the pad.

In the foregoing described apparatus and method, the top of the bag with the pad inside has sufficient stiffness to remain open to receive the oil dispensing nozzle when conveyed to the oil dispensing station. However, if the bags are formed of highly flexible material or are particularly large, the sides of the bag may be held open by an applied suction pressure upon movement of the bag into the oil dispensing station.

Accordingly, it is a primary object of the present invention to provide novel and improved methods and apparatus for impregnating oil into a lubricator pad.

It is another object of the present invention to provide novel and improved methods and apparatus for substantially automatically impregnating oil into a lubricating pad.

It is still another object of the present invention to provide novel and improved methods and apparatus for impregnating oil into a lubricator pad wherein the pad is both packaged and impregnated in a single manufacturing operation.

It is a further object of the present invention to provide novel and improved methods for impregnating oil into a lubricator pad which apparatus is simple in construction and easily utilized.

Additional objects and advantages of the invention will be set forth in part in the description which follows and in part will be obvious from the description or may be learned by practice of the invention. The objects and advantages of the invention may be realized and attained by means of the instrumentalities and combinations particularly pointed out in the appended claims.

To achieve the foregoing objects and in accordance with the present invention as embodied and broadly described herein, a method for impregnating oil into a lubricator pad in accordance with the present invention includes the steps of disposing the pad within an open bag, disposing or dispensing a predetermined quantity of lubricating oil into the bag, compressing the pad and bag to substantially exhaust air from the bag, sealing the compressed bag and pad, and relieving the bag and pad from such compression to enable expansion of the pad within the bag and consequent impregnation of the oil within the bag into the pad. In an alternate form of the present invention, the bag may be maintained open while a predetermined quantity of the lubricating oil is disposed in the open bag by applying suction to the opposite sides of the bag.

In another aspect of the present invention in accordance with a preferred embodiment hereof, the apparatus hereof includes a frame for supporting a pad disposed in an open, preferably plastic, bag, a nozzle carried by the frame for dispensing oil into the bag, means carried by the frame for compressing the bag and pad to substantially exhaust air from within the bag, and means carried by the support frame for sealing the bag containing the oil and pad while the pad and bag is maintained under compression. Preferably, the frame carries a conveyor for conveying the pad and bag through the oil dispensing station and compression and sealing station. The foregoin operations are carried out substantially automatically and it is necessary only to manually and initially dispose the dry pad in the plastic bag and to manually remove the hermetically sealed bag containing the oil impregnated pad from the conveyor frame.

These and further objects and advantages of the present invention will become more apparent upon reference to the following specification, appended claims and drawings wherein:

Figures 1, 1A, 2, 3:
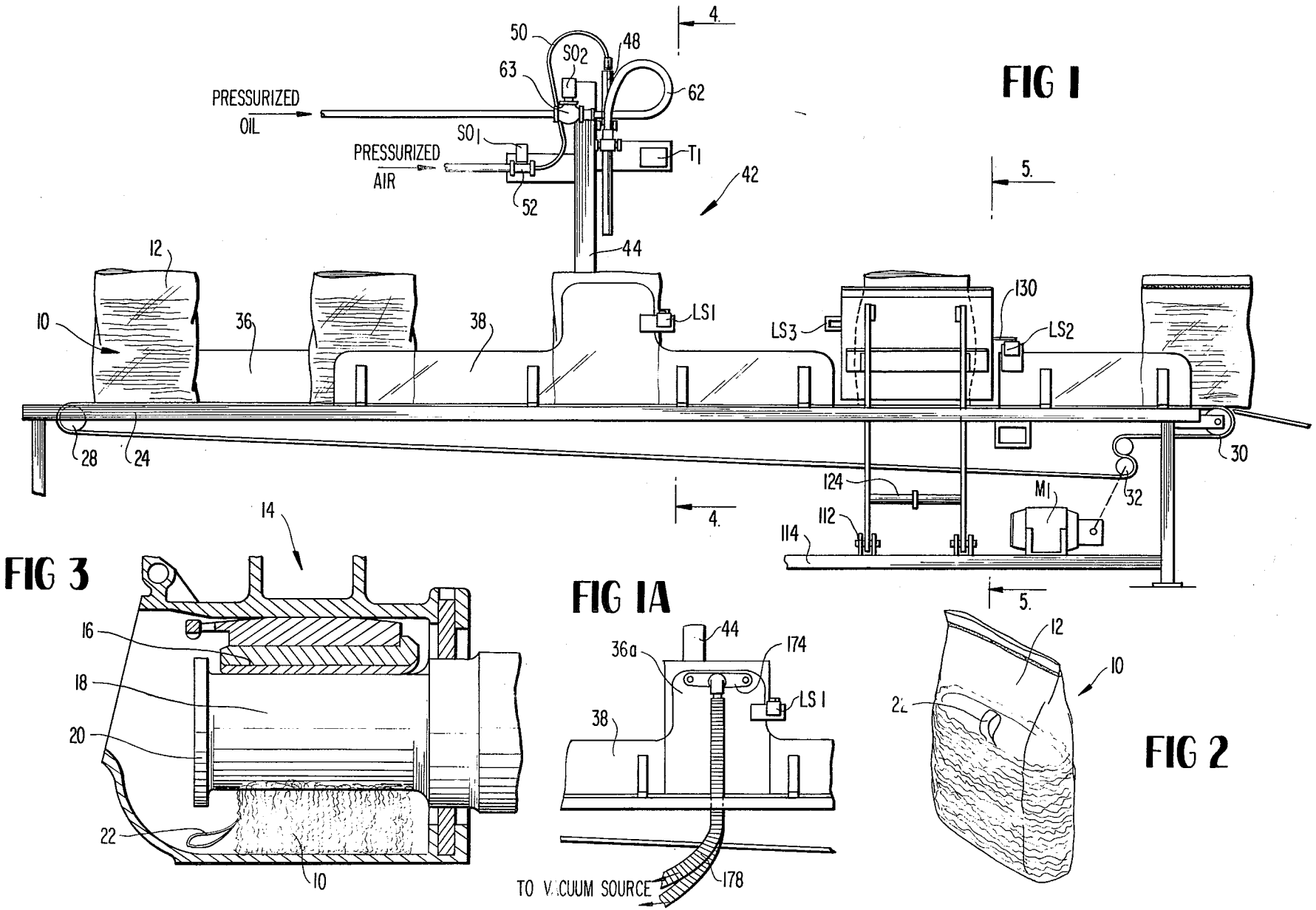
FIG. 1 is a fragmentary front elevational view of apparatus for use in impregnating oil into a lubricator pad constructed in accordance with the present invention.
FIG. 1A is a fragmentary front elevational view of an oil dispensing station forming part of an alternate form of the apparatus hereof.
FIG. 2 is a perspective view of the lubricator pad encapsulated within a plastic bag and comprising the product manufactured in accordance with the method and apparatus of the present invention.
FIG. 3 is a cross-sectional view of a journal box in which the lubricator pad may be utilized.

Referring now to the drawings, particularly to FIGS. 2 and 3, there is illustrated a lubricator pad or lubricator, generally designated 10, encapsulated within a sealed plastic bag 12. As will be appreciated from the ensuing description, the pad within bag 10 is fully impregnated with oil and, when removed from the bag, is ready for placement, for example, in a conventional railway journal box generally designated 14, and illustrated in FIG. 3. Journal box 14 houses a journal bearing 16 and the oil impregnated pad 10 is disposed below journal 18 in the journal box well behind the journal collar 20. When in position, the oil impregnated pad 10 provides a wicking action for lubricating journal 18. A pull-out strap 22 is carried by the pad to facilitate removal of the pad from the journal box.

Figure 5:
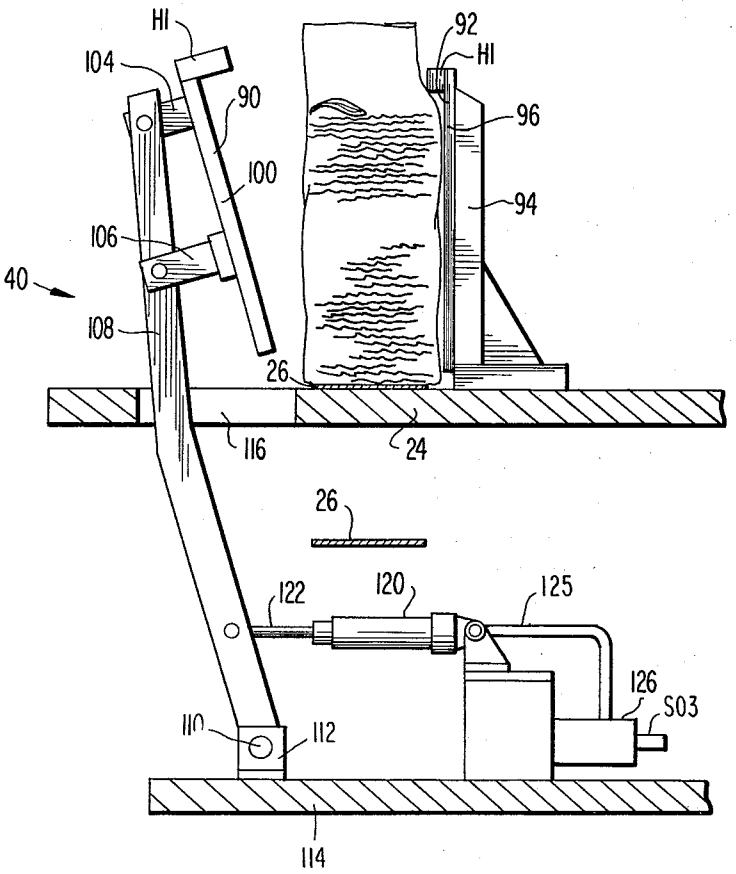
FIG. 5 is a cross-sectional view of the apparatus illustrated in FIG. 1 and taken generally about on line 5—5 therein.
Figure 4:
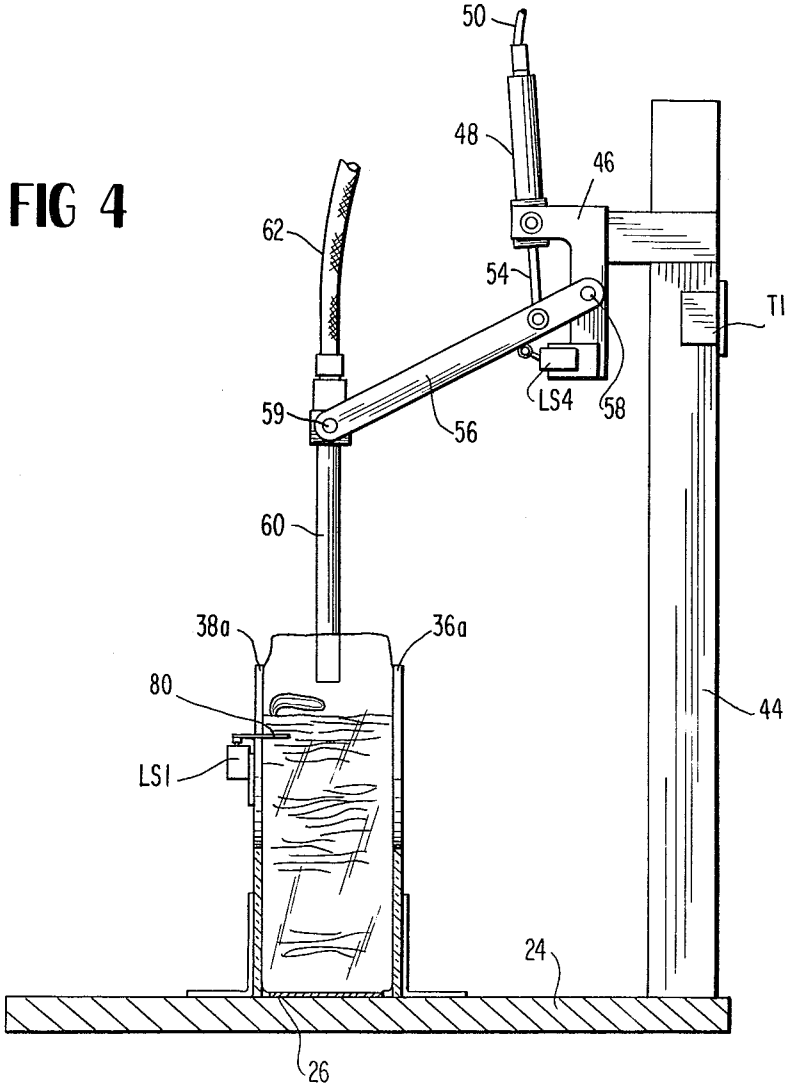
FIG. 4 is a cross-sectional view of the apparatus illustrated in FIG. 1 and taken generally on line 4—4 in FIG. 1.

Referring now particularly to FIGS. 1, 4 and 5, there is illustrated apparatus for impregnating oil into the lubricator pad 10 in accordance with the present invention including an elongated table or frame 24 on which is mounted an endless conveyor belt 26 disposed about idler and takeup pulleys 28 and 30 at opposite ends of table 24 and about a drive pulley 32 driven by motor M1. A pair of laterally spaced elongated guides 36 and 38 are provided on opposite sides of conveyor belt 26. Guides 36 and 38 are interrupted at the compression and heat seal station, generally designated 40 and discussed in detail hereinafter, with such guides 36 and 38 continuing on the downstream or right-hand end of conveyor table 24 as illustrated in FIG. 1. Guides 36 and 38 serve to maintain the plastic bags 12 containing the lubricators 10 on conveyor belt 26 as the bags and lubricators are conveyed along table 24 through a lubricating oil dispensing station, generally designated 42 and the compression and heat seal station 40 described hereinafter. Guides 36 and 38 have upright extensions 36*a* and 38*a* which straddle oil dispensing station 42.

As best illustrated in FIGS. 1 and 4, oil dispensing station 42 includes an upright support 44 secured to the back of conveyor table 24 and which support 44 carries an air cylinder 48 connected by a hose 50 and through a two-position four-way valve 52 to a source of air under pressure, not shown. Valve 52 is under control of solenoid SO1.

The piston rod 54 of air cylinder 48 is pivotally connected to an arm 56 intermediate the ends of arm 56. One end of arm 56 is pivotally coupled, at 58, to bracket 46 and its opposite end is pivotally connected, at 59, to an oil nozzle 60. It will be appreciated that by extending piston rod 54, arm 56 is pivoted downwardly to lower oil nozzle 60 while retraction of piston rod 54 raises the oil nozzle 60. A suitable hose 62 couples nozzle 60 to a source of oil under pressure, not shown, through a one-way-position valve 63 controlled by solenoid SO2.

A limit switch LS1 having a switch arm 80 projecting inwardly between the extensions 36*a* and 38*a* is carried by extension 38*a*. A timer T1 is also carried by support 44 for reasons discussed hereinafter.

Referring now particularly to FIGS. 1 and 5 and the compression and heat seal station 40, there is provided a pair of jaws 90 and 92. Jaw 92 is fixed on a suitable support 94 secured to table 24 and carries a generally vertically and longitudinally extending platen 96 flush with rear guide 36. The upper end of platen 96 carries a heat sealing element H1.

The laterally opposed jaw 90 comprises a platen 100 also carrying a heat sealing element H1 at its upper end for cooperation with opposed heat sealing element H1 in a manner set forth below. Platen 100 is carried by brackets 104 and 106 on a pair of upstanding arms 108 pivotally connected at their lower ends at 110 to a pair of clevises 112 carried on a motor support and compression arm frame 114. Table 24 is slotted at 116 (FIG. 5) to receive arms 108 to enable pivotal movement of platen 100 carried by arms 108 toward and away from platen 96. An air cylinder 120 has its piston rod 122 pivotally connected to a cross bracket 124 carried by arms 108. Air under pressure is supplied to cylinder 120 through a suitable hose 125 in communication with a source of air under pressure, not shown, through a four-way two-position valve 126 operated by solenoid SO3. It will be appreciated that retraction of piston rod 122 causes platen 100 to move toward the opposing platen 96 and the heat sealing element H1 toward its opposing heat sealing element H1.

Carried by guide 38 is a limit switch LS2 having a limit switch arm 130 extending into the path of movement of the bags moving along conveyor 26 for purposes discussed hereinafter. Also, a limit switch LS3 is carried by fixed platen 96 and is actuated upon movement of platen 100 into its extreme compressing position.

Figure 6:
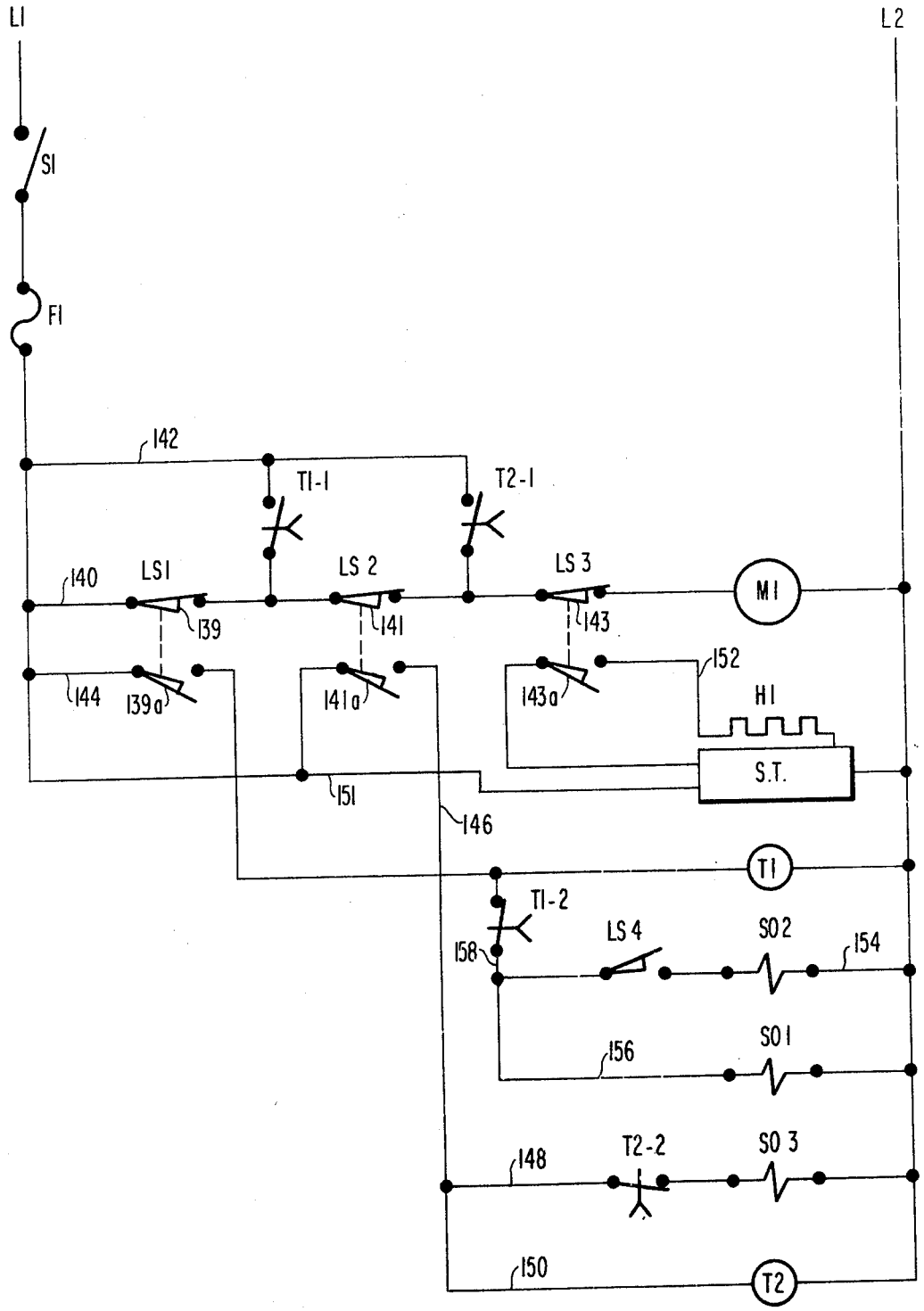
FIG. 6 is a schematic diagram illustrating electrical circuitry for use with the apparatus in accordance with the present invention.

Referring now to FIG. 6, there is illustrated a schematic diagram illustrating the electrical circuitry for the apparatus of the present invention. Particularly, in FIG. 6, there is illustrated a pair of supply lines L1 and L2 connected across a power source, not shown. Normally closed contact pairs 139, 141, and 143 of limit switches LS1, LS2 and LS3 respectively are connected in series with motor M1 in line 140 connected across supply lines L1 and L2. Timer controlled spring loaded contacts T1-1 and T2-1 are connected in parallel across supply line L1 and line 140 in line 142. Contacts T1-1 and T2-1 are normally open when the corresponding timers T1 and T2 are deenergized, timers T1 and T2 being of the delay type. Contacts T1-1 connect between line 142 and 140 between limit switches LS1 and LS2 while contacts T2-1 connect between line 142 and limit switches LS2 and LS3. Each of the limit switches LS1, LS2 and LS3 have a corresponding normally open contact pair 139*a*, 141*a*, and 143*a* respectively and the normally open contact pair of limit switch LS1 is connected in series with timer T1 by line 144 connected across supply line L1 and L2. The normally open contact pair of limit switch LS2 connects with line L1 via line 146. Normally closed contacts T2-2 and solenoid SO3 are connected in parallel with timer T2 via lines 148 and 150, respectively, connected between line 146 and supply line L2. A sealing element temperature control unit S.T. is connected across lines L1 and L2 by line 151. Control unit S.T. may comprise the Verdrod Thermal Impulse Sealing Machine, Model 20A-4-4. The normally open contact pair 143*a* of limit switch LS3 and heat seal element H1 are connected in series by line 152 and across open contacts, not shown, carried by control unit S.T. Normally open switch LS4 and solenoid SO2 are connected in series in line 54 and solenoid S01 is connected in parallel therewith in line 156. Lines 154 and 156 connect with line L2 and with a line 158 coupled through normally closed contacts T1-2 to line 144 between the normally open contact pair of limit switch LS1 and timer T1.

In operation, dry lubricator pads are placed within plastic bags 12 and these are placed on conveyor 26. Switch S1 in line L1 is closed and motor M1 is thus energized through line 140 and the normally closed contact pairs of limit switches LS1, LS2 and LS3 to start conveyor 26. Consequently, the bags containing the dry pads are conveyed along conveyor table 24 toward lubricating oil dispensing station 42. When a bag and pad are located between extensions 36*a* and 38*a* in the oil dispensing station 42, bag 12 engages arm 80 and the normally closed contact pair 139 of limit switch LS1 in line 140 opens and the normally open contact pair 139*a* of limit switch LS1 in line 144 closes. Opening limit switch LS1 deenergizes motor M1 causing conveyor 26 to stop. Closing normally open contact pair 139*a* of limit switch LS1 energizes timer T1 in line 144 and energizes oil nozzle solenoid SO1 in line 156 through the normally closed contact pair T1-2 in line 158. Energization of solenoid SO1 shifts valve 52 to supply air under pressure to cylinder 48 whereby cylinder rod 54 is extended lowering arm 56 and extending oil nozzle 60 into the open upper end of the bag 12.

When the oil nozzle is fully extended into the open bag 12, arm 56 closes normally open limit switch LS4 thereby energizing solenoid SO2 in line 154 through normally closed contacts T1-2 in line 158. Energization of solenoid SO2 starts flow of oil through hose 62 and nozzle 60 into bag 12. A predetermined quantity of oil flows in accordance with the duration of the timer T1. When timer T1 times out, contacts T1-2 open deenergizing solenoids SO1 and SO2. Deenergization of solenoid SO2 stops the flow of oil and deenergizing solenoid SO1 causes valve 52 to shift to raise piston rod 54 of air cylinder 48 thereby raising nozzle 60 above the open upper end of the bag 12. Timing out of timer T1 also closes contacts T1-1 thereby energizing motor M1. Conveyor 26 is thus restarted and the bag containing the oil and pad are moved toward the compressing and sealing station 40.

Once the bag moves past limit switch LS1, it returns contact pairs 139 and 139*a* to their respective normally closed and open positions. Opening contact pair 139*a* deenergizes timer T1 enabling contact pairs T1-1 and T1-2 to spring return to their normally open and closed positions respectively.

When conveyor 26 locates the bag containing the pad and oil in the compression and seal station 40 between platens 96 and 100, the bag engages the arm 130 of limit switch LS2 opening the normally closed contact pair 141 to deenergize motor M1 and stop conveyor 26. Actuation of limit switch LS2 also closes normally open contact pair 141*a* to energize timer T2 in line 150 and solenoid SO3 in line 148 through normally closed contacts T2-2. Energization of solenoid SO3 causes air cylinder 120 to retract piston rod 122 moving arm 108 such that platen 100 compresses the bag containing the pad and oil between it and platen 96. Once full compression of the bag and pad is obtained with the air in the bag substantially entirely exhausted therefrom, the arm actuates limit switch LS3 opening normally closed contact pair 143 and closing normally open contact pair 143*a* in line 152. Closing contact pair 143*a* energizes heat sealing element H1 in line 152. The opposite sides of bag 12 are heat sealed one to the other while the bag and pad are compressed and the bag is substantially evacuated of air thus hermetically sealing bag 12. After timer T2 times out, contacts T2-2 open to deenergize solenoid SO3 and actuate air cylinder 120 to extend its piston 122 whereby platen 100 is returned to its original position. Timing out of timer T2 also closes contacts T2-1 as well as returns limit switch LS3 to its original position. With contact pairs T2-1 and 143 closed, motor M1 is energized to start conveyor 26.

Once the bag containing the pad and oil is moved by conveyor 26 past the compression and sealing station 40, limit switch LS2 returns to its normal position closing contact pair 141 and opening contact pair 141*a*. Opening contact pair 141*a* deenergizes timer T2 enabling contact pairs T2-1 and T2-2 to spring return to their normally open and closed position respectively.

It will be appreciated that evacuation of substantially all of the air in the plastic bag with the oil and pad therein and hermetically sealing the bag enables the pad to expand substantially to its original volume once the compression is relieved. This natural expansion of the pad within the hermetically sealed bag 12 enables absorption or impregnation of the oil into the pad. The oil-saturated pad is maintained in the plastic bag until use at which time it is removed therefrom and disposed in the journal box illustrated in FIG. 3.

In an alternate form of the present invention for use particularly when the bags are formed of highly flexible material or when large bags are used, a vacuum suction may be applied to the opposite sides of the bag when at the oil dispensing station 42. For example, as illustrated in FIG. 1A, a pair of vacuum nozzles 174 may be disposed along opposite sides of conveyor table 24 and supported by upright extensions 36*a* and 38*a*. Nozzles 174 are connected through suitable hoses 178 to a vacuum source, not shown. Nozzles 174 are longitudinally elongated and open through respective extensions 36*a* and 38*a* to apply a constant suction force interiorly of extensions 36*a* and 38*a* to the respective opposite sides of bag 12 as it passes through oil dispensing station 42. The side margins of bag 12 may thus be held against the inside surfaces of the upper extensions 36*a* and 38*a* by the suction applied through suction nozzles 174 in order to hold the upper end of bag 12 open.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. An automated method for impregnating oil into a pad and packaging same comprising the steps of:

(a) positioning a succession of bags with open ends in an upright position on a continuous belt-like conveying means;

(b) loading an oil impregnable pad in each of the open ended bags;

(c) transferring the bag with the loaded pad along the conveying means between two opposing continuous vertical bag-support walls to a first dispensing station with an overhead dispensing means;

(d) sensing the presence of a bag with the loaded pad at the first station;

(e) temporarily stopping transfer of the bag with the loaded pad on the conveying means upon sensing the presence of the bag at the first station;

(f) dispensing a predetermined quantity of oil into the bag with the pad by the overhead dispensing means actuated upon sensing the presence of the bag and after stopping transfer of same at the first station;

(g) transferring the bag containing the oil and pad along the conveying means between the two continuous bag-support walls from the first station to a second compression and sealing station having two opposing vertical platens contiguous with the two bag-support walls, at least one of the platens being movable toward the other;

(h) sensing the presence of the bag with the oil and pad at the second station between the two opposing vertical platens;

(i) temporarily stopping transfer of the bag with the oil and pad on the conveying means upon sensing the presence of the bag at the second station;

(j) compressing the bag with the oil and pad sufficient only to allow impregnation of the pad with oil and to substantially exhaust the air from the bag by the at least one platen moving toward the other platen a predetermined compression distance actuated upon sensing the presence of the bag and after stopping transfer of same at the second station;

(k) simultaneously sealing the opposite sides of the bag to each other adjacent its upper end at the second station by sealing means, mounted on each platen, contacting the upper ends of the bag when the platens are moved together the predetermined compression distance;

(l) subsequently relieving the sealing and compression of the bag at the second station by the at least one platen moving back to its original position contiguous with the corresponding bag-support wall;

(m) transferring the sealed bag with the impregnated pad along the conveying means between the two opposing vertical bag-support walls from the second station; and (n) unloading the sealed bag with the impregnated pad from the conveying means.

2. A method according to claim 1 wherein step (f) further includes the step of holding the upper end of the bag open while dispensing the oil into the bag.

3. A method according to claim 1 wherein step (f) further includes the step of applying a suction to the opposite sides of said bag adjacent its upper end to hold the bag open while dispensing the oil into the bag.

4. A method according to claim 3 wherein step (f) further includes the steps of lowering the dispensing means into the bag through its open upper end, dispensing the oil from said dispensing means while lowered into the bag, and raising the dispensing means out of the bag after dispensing the predetermined quantity of oil into the bag.

5. A method according to claim 1 wherein step (k) comprises heat sealing the opposite sides of the bag one to the other to hermetically seal the bag while maintaining the pad and bag under compression by heat sealing means, mounted on each platen, contacting each other when the platens are moved together the predetermined compression distance.

6. Automated apparatus for impregnatng oil into a pad and packaging same comprising:

(a) a support frame;

(b) continuous belt-like conveying means positioned substantially horizontally along said support frame for advancing and transferring a series of open-ended bags with pads disposed therein positioned on said conveying means, and wherein two continuous vertical support walls are positioned along the opposing sides of said conveying means for maintaining the series of bags in an upright position during transfer;

(c) means carried by said support frame, including a nozzle, over said conveying means at a predetermined first station along said conveying means for dispensing a predetermined quantity of oil into the series of open-ended bags containing the pads;

(d) means responsive to movement of a bag positioned on said conveying means into said predetermined first station and under said dispensing means for temporarily stopping said conveying means and actuating said dispensing means to flow oil into the positioned bag;

(e) means responsive to the completed flow of the predetermined quantity of oil into the gag for starting said conveying means to advance the series of bags along said conveying means;

(f) means carried by said support frame at a predetermined second station along said conveying means downstream of said first station for compressing a bag containing the oil and pad sufficient only to allow impregnation of the pad with oil and to substantially exhaust the air from the bag and for sealing the bag containing the oil and pad during compression, and wherein said compressing and sealing means includes two vertical platens positioned along the opposing sides of said conveying means contiguous with said vertical bag-support walls, at least one of said platens being movable a predetermined distance toward the other platen for compressing a bag containing the oil and pad positioned therebetween on said conveying means, and sealing means located at the upper ends of said platens for sealing the opposite upper ends of said bag when said platens are moved toward each other the predetermined compression distance;

(g) means responsive to movement of a bag on said conveying means positioned at said second station between said platens for stopping said conveying means, activating said at least on platen for movement toward the opposing platen the predetermined compression distance, and for returning said at least one platen to its original position;

(h) means responsive to the return of said at least one platen to its original position contiguous with the corresponding vertical bag-support wall for starting said conveying means to advance the sealed bag containing the impregnated pad along said conveying means.

7. Apparatus according to claim 6 including means on opposite sides of the bag at the first predetermined station for holding the upper end of the bag open while dispensing oil into the bag.

8. Apparatus according to claim 7 wherein said holding means includes means for applying a vacuum suction to the opposite sides of the bag.

9. Apparatus according to claim 6 wherein said nozzle is lowerable into the open end of the bag positioned at said first predetermined station for dispensing the predetermined quantity of oil into the bag and raisable out of the open end of the bag after dispensing the predetermined quantity of oil.

* * * * *